US009651064B2

(12) United States Patent
Sohn

(10) Patent No.: US 9,651,064 B2
(45) Date of Patent: May 16, 2017

(54) BOOM CYLINDER CONTROL CIRCUIT FOR CONSTRUCTION MACHINE

(71) Applicant: DOOSAN INFRACORE CO., LTD., Incheon (KR)

(72) Inventor: Won Sun Sohn, Seoul (KR)

(73) Assignee: Doosan Infracore Co., Ltd., Incheon (KR)

( * ) Notice: Subject to any disclaimer, the term of this patent is extended or adjusted under 35 U.S.C. 154(b) by 372 days.

(21) Appl. No.: 14/369,535

(22) PCT Filed: Dec. 18, 2012

(86) PCT No.: PCT/KR2012/010976
§ 371 (c)(1),
(2) Date: Jun. 27, 2014

(87) PCT Pub. No.: WO2013/100458
PCT Pub. Date: Jul. 4, 2013

(65) Prior Publication Data

US 2014/0360174 A1 Dec. 11, 2014

(30) Foreign Application Priority Data

Dec. 28, 2011 (KR) ..... 10-2011-0144226

(51) Int. Cl.
*E02F 9/22* (2006.01)
*F15B 13/04* (2006.01)
(Continued)

(52) U.S. Cl.
CPC ..... *F15B 13/0401* (2013.01); *E02F 9/2203* (2013.01); *E02F 9/226* (2013.01);
(Continued)

(58) Field of Classification Search
CPC ..... E02F 9/2203
See application file for complete search history.

(56) References Cited

U.S. PATENT DOCUMENTS 3,630,121 A * 12/1971 Landaeus ..... E02F 9/2203 91/437
3,874,269 A 4/1975 Walters
(Continued)

FOREIGN PATENT DOCUMENTS

CN 102216532 A 10/2011
EP 1790781 A1 5/2007
(Continued)

OTHER PUBLICATIONS

Search Report dated Apr. 1, 2013 and written in Korean with English translation for International Patent Application No. PCT/KR2012/010976 filed Dec. 18, 2012, 5 pages.
(Continued)

*Primary Examiner* — F. Daniel Lopez
(74) *Attorney, Agent, or Firm* — John D. Veldhuis-Kroeze; Westman, Champlin & Koehler, P.A.

(57) ABSTRACT

The present disclosure relates to a boom cylinder control circuit for a construction machine, and includes: a boom cylinder which has an ascending-side chamber and a descending-side chamber; a boom control unit which provides a working fluid to the boom cylinder; a boom operation part which is operated to drive the boom cylinder by providing a pilot working fluid to the boom control unit; a first floating valve which allows the descending-side chamber and the ascending-side chamber to selectively communicate with or be shut off from a first drain line; a second floating valve which is additionally provided in a flow path between the descending-side chamber, which is connected with the first drain line via the first floating valve, and the first drain line, allows the descending-side chamber to communicate with the first drain line, or shut off discharge of the working fluid from the descending-side chamber to the first drain line, and allows of a reverse flow; and a floating selection operation part which provides an operation signal so that the first floating valve and the second floating
(Continued)

valve are switched in a direction in which the first floating valve and the second floating valve are communicated or shut off.

6 Claims, 3 Drawing Sheets

(51) Int. Cl.
*F15B 7/00* (2006.01)
*F15B 13/042* (2006.01)

(52) U.S. Cl.
CPC ..... *E02F 9/2285* (2013.01); *F15B 7/003* (2013.01); *F15B 13/042* (2013.01)

(56) References Cited

U.S. PATENT DOCUMENTS 4,024,796 A 5/1977 Theobald
5,351,601 A * 10/1994 Zeuner ..... F15B 11/003 60/468
6,389,952 B1 5/2002 Riddick et al.

FOREIGN PATENT DOCUMENTS

| | | |
|---|---|---|
| JP | H09-195308 | 7/1997 |
| JP | 2010084333 A | 4/2010 |
| KR | 20-0333340 | 3/2004 |
| KR | 10-0588285 | 6/2006 |
| KR | 10-2010-0056087 | 5/2010 |
| KR | 10-2010-0134827 | 12/2010 |

OTHER PUBLICATIONS

European Search Report mailed Aug. 24, 2015 for European Application No. 12863793.1, 7 pages.
Chinese Office Action mailed Oct. 29, 2015 for Chinese Application No. 201280065520.X, 5 pages.

* cited by examiner

BOOM CYLINDER CONTROL CIRCUIT FOR CONSTRUCTION MACHINE

CROSS-REFERENCE TO RELATED APPLICATION

This application is a Section 371 National Stage Application of International Application No. PCT/KR2012/010976, filed Dec. 18, 2012 and published, not in English, as WO 2013/100458 on Jul. 4, 2013.

FIELD OF THE DISCLOSURE

The present disclosure relates to a boom cylinder control circuit for a construction machine, and more particularly, to a boom cylinder control circuit for a construction machine, which allows a general work mode, a unidirectional floating mode, and a bidirectional floating mode to be implemented by controlling a boom cylinder that moves a boom upward and downward.

BACKGROUND OF THE DISCLOSURE

In general, a construction machine such as an excavator may perform work for flattening the ground while moving a bucket forward and rearward. In order to perform the work for flattening the ground, a worker needs to precisely control motion of the boom and the bucket so as to constantly maintain a load applied to the ground surface by the bucket.

Therefore, a degree of fatigue felt by the worker is inevitably high in order to perform the work for flattening the ground.

In addition, in a case in which the boom is not precisely controlled during the work for flattening the ground, force applied to the ground surface by the bucket is very large, such that the bucket may be buried too much into the ground surface. On the contrary, in a case in which force applied to the ground surface by the bucket is very small, the work for flattening the ground cannot be properly performed.

Meanwhile, the construction machine also uses an optional device such as a breaker by substituting the bucket. The breaker is an optional device for breaking rocks, a paved road, and the like, and needs to apply a predetermined force to an object to be broken.

However, when the breaker performs work, a reaction in which the boom bounds upward at the moment when the breaker breaks the object to be broken occurs. Therefore, the worker needs to more precisely control the boom and the breaker.

Recently, researches on a configuration that allows the bucket to apply a predetermined force to an object such as a ground surface or a rock using a weight of the boom are being conducted in order to resolve the aforementioned inconvenience. Particularly, because the boom bounds upward when the breaker performs work, work characteristics need to be considered even though the weight of the boom is used.

There is Patent Literature 1 that is previously filed by the applicant of the present disclosure, and laid open.

However, a boom cylinder control circuit disclosed in Patent Literature 1 has the following problem.

A large amount of working fluid is discharged from a boom cylinder, and a small amount of working fluid is discharged from a spool of a boom control unit. Here, since paths through which the large amount of working fluid and the small amount of working fluid are discharged are not clear, in a case in which the large amount of working fluid and the small amount of working fluid are merged into a single drain line without dividing the large amount of working fluid and the small amount of working fluid, the large amount of working fluid, which is discharged to a drain tank when boom floating is performed, may cause pressure interference in a pilot line, and the interference may cause an erroneous operation when the boom is controlled.

In addition, pressure may be generated in spring chambers of a floating selection valve, a first floating valve, and a second floating valve due to a valve oil leakage, and the pressure may cause erroneous operations of the respective valves.

In addition, in a case a reverse load occurs on the boom cylinder when an unidirectional floating mode is selected, and the working fluid is held at a rod side of the boom cylinder, the working fluid is not replenished at the rod side of the boom cylinder, such that cavitation may occur, and as a result, rattling during a boom descending motion occurs when the boom is moved downward due to boom floating.

LITERATURE OF RELATED ART (Patent Literature 1) Korean Patent Application Laid-Open No. 10-2010-0056087 (May 27, 2010)

The discussion above is merely provided for general background information and is not intended to be used as an aid in determining the scope of the claimed subject matter.

SUMMARY

This summary and the abstract are provided to introduce a selection of concepts in a simplified form that are further described below in the Detailed Description. The summary and the abstract are not intended to identify key features or essential features of the claimed subject matter, nor are they intended to be used as an aid in determining the scope of the claimed subject matter.

Accordingly, a technical problem to be achieved in the present disclosure is to provide a boom cylinder control circuit for a construction machine, which allows a weight of a boom to be efficiently used in accordance with work characteristics, thereby improving convenience for work.

A technical problem to be achieved in the present disclosure is not limited to the aforementioned technical problem, and any other not-mentioned technical problem will be obviously understood from the description below by those skilled in the technical field to which the present disclosure pertains.

In order to achieve the technical problem, a boom cylinder control circuit for a construction machine according to the present disclosure includes: a boom cylinder 1 which has an ascending-side chamber 1*a* and a descending-side chamber 1*b*; a boom control unit 4 which provides a working fluid to the boom cylinder 1; a boom operation part 3 which is operated to drive the boom cylinder 1 by providing a pilot working fluid to the boom control unit 4; a first floating valve 30 which allows the descending-side chamber 1*b* and the ascending-side chamber 1*a* to selectively communicate with or be shut off from a first drain line t1; a second floating valve 40 which is additionally provided in a flow path between the descending-side chamber 1*b*, which is connected with the first drain line t1 via the first floating valve 30, and the first drain line t1, allows the descending-side chamber 1*b* to communicate with the first drain line t1, or shuts off discharge of the working fluid from the descending-side chamber 1*b* to the first drain line t1, and allows of a reverse flow; and a floating selection operation part 10 which provides an operation signal so that the first floating valve 30 and the second floating valve 40 are switched in a direction in which the first floating valve 30 and the second floating valve 40 are communicated or shut off.

In addition, in the boom cylinder control circuit for a construction machine according to the present disclosure, first and second input ports 31 and 32, which are connected to the descending-side chamber 1*b* and the ascending-side chamber 1*a*, respectively, may be provided at one side of the first floating valve 30, a first output port 33, which is connected with the second floating valve 40, and a second output port 34, which is connected with the first drain line t1, may be provided at the other side of the first floating valve 30, one side of the second floating valve 40 may be connected to the first output port 33, and the other side of the second floating valve 40 may be connected to the first drain line t1.

In addition, the boom cylinder control circuit for a construction machine according to the present disclosure may further include a floating selection valve 50 which is provided in a boom descending signal line 3*b* of the boom operation part 3, in which the floating selection valve 50 connects the boom descending signal line 3*b* to a descending pressure receiving part 4*b* of the boom control unit 4, and connects a pressure receiving part 36 of the first floating valve 30 to a second drain line t2 at a first spool position 50A, the floating selection valve 50 connects the boom descending signal line 3*b* to the pressure receiving part 36 of the first floating valve 30, and connects the descending pressure receiving part 4*b* of the boom control unit 4 to the second drain line t2 at a second spool position 50B, and the floating selection valve 50 is selectively switched to the first and second spool positions 50A and 50B based on an operation signal of the floating selection operation part 10.

In addition, the boom cylinder control circuit for a construction machine according to the present disclosure may further include a floating release operation part 20 which provides a signal prior to the signal of the floating selection operation part 10 so as to selectively switch the floating selection valve 50 to the first spool position 50A or the second spool position 50B.

In addition, in the boom cylinder control circuit for a construction machine according to the present disclosure, any one spring chamber of a first spring chamber 35 of the first floating valve 30, a second spring chamber 43 of the second floating valve 40, and a third spring chamber 55 of the floating selection valve 50 may be connected to the second drain line t2.

Specific items of other exemplary embodiments are included in the detailed description and the drawings.

According to the boom cylinder control circuit for a construction machine according to the present disclosure, which is configured as described above, the unidirectional floating function and the bidirectional floating function may be implemented by a simple operation by the first floating valve and the second floating valve, thereby improving work efficiency and convenience for a worker.

In addition, according to the boom cylinder control circuit for a construction machine according to the present disclosure, the first floating valve and the second floating valve are connected with each other in series so as to prevent an unnecessary floating function (for example, in a case in which only the descending-side chamber of the boom cylinder is floated) from being selected, and a control circuit for floating selection may be easily implemented.

In addition, according to the boom cylinder control circuit for a construction machine according to the present disclosure, the first floating valve is switched by the signal pressure of the boom descending signal line, thereby preventing a safety accident that occurs while the boom falls suddenly at the same time as the floating function selection.

In addition, according to the boom cylinder control circuit for a construction machine according to the present disclosure, in a case in which a load, which is equal to or greater than a weight of the boom, is required for work for hardening the ground surface during work for flattening the ground surface, the floating function may be temporarily released by switching the floating selection valve by the floating release operation part, thereby greatly improving work efficiency.

In addition, according to the boom cylinder control circuit for a construction machine according to the present disclosure, the floating mode may return to the floating mode before releasing the floating mode by the floating release operation part, thereby further improving operational convenience.

In addition, according to the boom cylinder control circuit for a construction machine according to the present disclosure, a large amount of working fluid and a small amount of working fluid are separately discharged when the working fluid is discharged from the first and second floating valves, such that interference due to a pressure difference between a side at which the large amount of working fluid is discharged, and a side at which the small amount of working fluid is discharged does not occur, thereby more stably controlling the boom cylinder.

In addition, according to the boom cylinder control circuit for a construction machine according to the present disclosure, the drain line is provided in the respective spring chambers of the first floating valve, the second floating valve, and the floating selection valve, thereby preventing a valve oil leakage in the valves or erroneous operations of the valves due to abnormal back pressure.

In addition, in the boom cylinder control circuit for a construction machine according to the present disclosure, a make-up function using the second floating valve is added when unidirectional floating is performed, such that the working fluid is additionally provided to the boom cylinder rod part (descending-side chamber) when a reverse load is applied to the boom cylinder, thereby resolving the problem with rattling that occurs during the operation due to cavitation.

DESCRIPTION OF MAIN REFERENCE NUMERALS OF DRAWINGS

Figure 1:
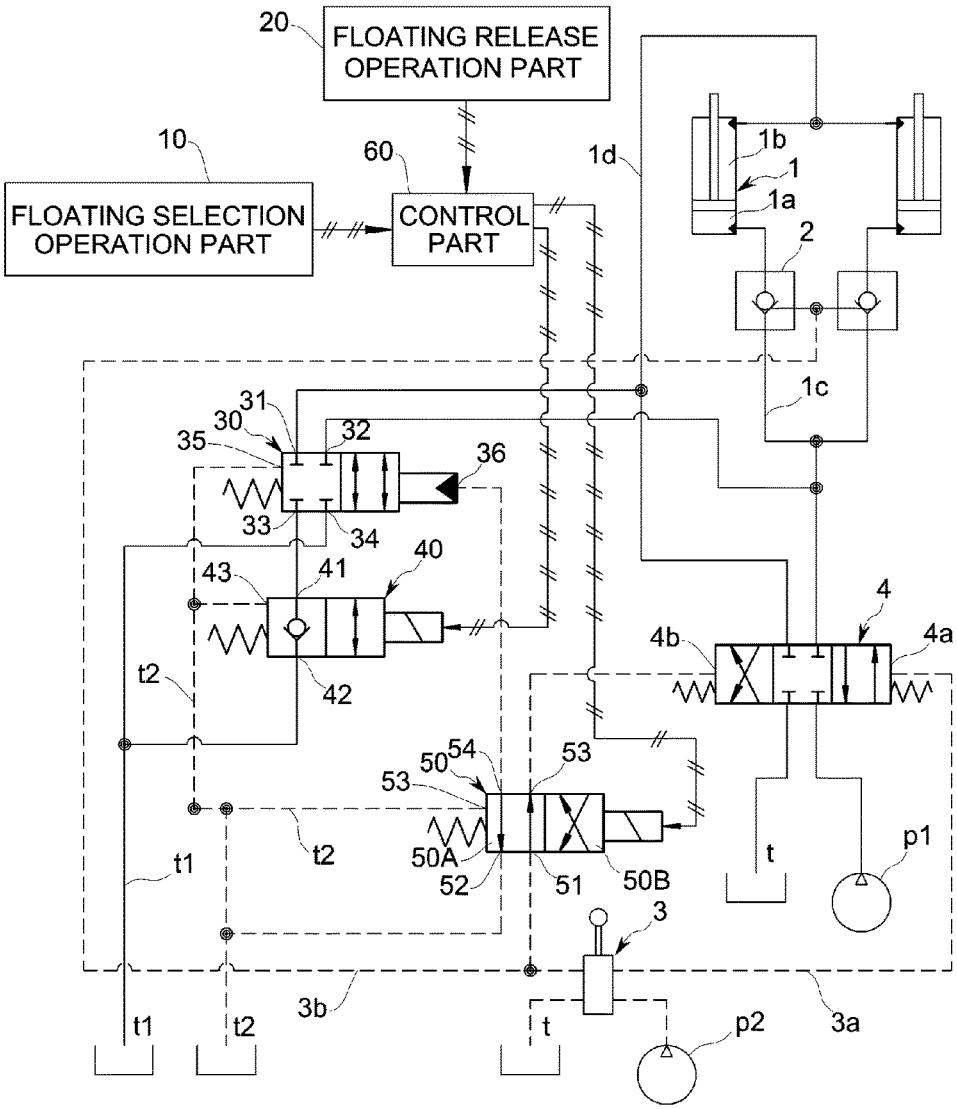
FIG. 1 is a view for explaining a boom cylinder control circuit for a construction machine according to an exemplary embodiment of the present disclosure, which schematically illustrates a state in which a general mode is selected.

1: Boom cylinder
1*a*: Ascending-side chamber
1*b*: Descending-side chamber
1*c*: Boom ascending hydraulic line
1*d*: Boom descending hydraulic line
2: Boom holding valve
3: Boom operation part
3*a*: Boom ascending signal line
3*b*: Boom descending signal line
4: Boom control unit
4*a*: Boom ascending pressure receiving part
4*b*: Boom descending pressure receiving part
10: Floating selection operation part
20: Floating release operation part
30: First floating valve
31, 32: First and second input ports
33, 34: First and second output ports
35, 43, 55: First, second, and third spring chambers
36: Pressure receiving part
40: Second floating valve
41, 42: First and second ports
50: Floating selection valve
51, 52, 53, 54: Third, fourth, fifth, and sixth ports
60: Control part
p1: Hydraulic pump
p2: Pilot pump
t: Drain tank
t1, t2: First and second drain lines

DETAILED DESCRIPTION

Advantages and features of the present disclosure and methods of achieving the advantages and features will be clear with reference to an exemplary embodiment described in detail below together with the accompanying drawings.

Like reference numerals indicate like elements throughout the specification.

Hereinafter, a boom cylinder control circuit for a construction machine according to an exemplary embodiment of the present disclosure will be described with reference to FIG. 1.

The attached FIG. 1 is a view for explaining the boom cylinder control circuit for a construction machine according to the exemplary embodiment of the present disclosure, which schematically illustrates a state in which a general mode is selected.

As illustrated in FIG. 1, the boom cylinder control circuit for a construction machine according to the exemplary embodiment of the present disclosure may efficiently control a so-called floating state in which an ascending-side chamber 1*a* and a descending-side chamber 1*b* of a boom cylinder 1 are selectively connected with a first drain line t1 in accordance with work characteristics.

Particularly, the boom cylinder control circuit according to the exemplary embodiment of the present disclosure may efficiently implement both a bidirectional floating mode in which both the ascending-side chamber 1*a* and the descending-side chamber 1*b* of the boom cylinder 1 are floated, and a unidirectional floating mode in which only the ascending-side chamber 1*a* of the boom cylinder 1 is floated.

The boom cylinder control circuit for a construction machine, which serves to implement the aforementioned functions, includes a floating selection operation part 10, a first floating valve 30, a second floating valve 40, a floating selection valve 50, a control part 60, and a floating release operation part 20.

The floating selection operation part 10 serves to select any one of the three types of modes, and as the three types of modes, there are a general work mode, the unidirectional floating mode, and the bidirectional floating mode. The floating selection operation part 10 may be implemented by three position buttons or the like.

The general work mode is a general work state in which a floating function is not implemented.

The bidirectional floating mode is a state in which ascending motion and descending motion of a boom are freely performed, and a state in which a ground surface is pressed by a weight of the boom, or the boom may be raised by resistance due to resistance from the ground surface that is not depressed, and the bidirectional floating mode may be a mode in which flattening work or ground leveling work is performed, and will be described in more detail below.

The unidirectional floating mode is a state in which the ascending motion of the boom is suppressed, and only the descending motion of the boom is permitted, may be a breaker mode in which an object to be broken is broken, and the unidirectional floating mode will be described below in more detail.

First, the boom cylinder control circuit and the general work mode according to the exemplary embodiment of the present disclosure will be described with reference to FIG. 1.

The first floating valve 30 serves to selectively connect the ascending-side chamber 1*a* and the descending-side chamber 1*b* of the boom cylinder 1 to the first drain line t1. When the ascending-side chamber 1*a* and the descending-side chamber 1*b* of the boom cylinder 1 are shut off, and any one mode of the unidirectional floating mode and the bidirectional floating mode is selected by the floating selection operation part 10 at the initial time, the first floating valve 30 is switched so that the ascending-side chamber 1*a* and the descending-side chamber 1*b* of the boom cylinder 1 communicate with the first drain line t1.

More specifically, first and second input ports 31 and 32 are provided at one side of the first floating valve 30, and first and second output ports 33 and 34 are provided at the other side of the first floating valve 30.

The first input port 31 is connected to the descending-side chamber 1*b* of the boom cylinder 1, and the second input port 32 is connected to the ascending-side chamber 1*a* of the boom cylinder 1.

The first output port 33 is connected to the second floating valve 40, and the second output port 34 is connected to the first drain line t1.

In addition, a first spring chamber 35 of the first floating valve 30 is connected to a second drain line t2.

In an initial state in which the first floating valve 30 is present as illustrated in FIG. 1, the ascending-side chamber 1*a* and the descending-side chamber 1*b* of the boom cylinder 1 are in the shut-off state.

When a boom operation part 3 is operated in the aforementioned state, a pilot signal pressure generated from the boom operation part 3 is provided to a boom ascending pressure receiving part 4*a* and a boom descending pressure receiving part 4*b* of a boom control unit 4, and the boom control unit 4 is controlled based on the provided pilot signal pressure.

Thereafter, a working fluid discharged from a main pump p1 is supplied to the ascending-side chamber 1*a* or the descending-side chamber 1*b* of the boom cylinder 1 while a flow direction of the working fluid is controlled by the boom control unit 4, and as a result, the boom cylinder 1 moves the boom upward or downward.

Figure 2:
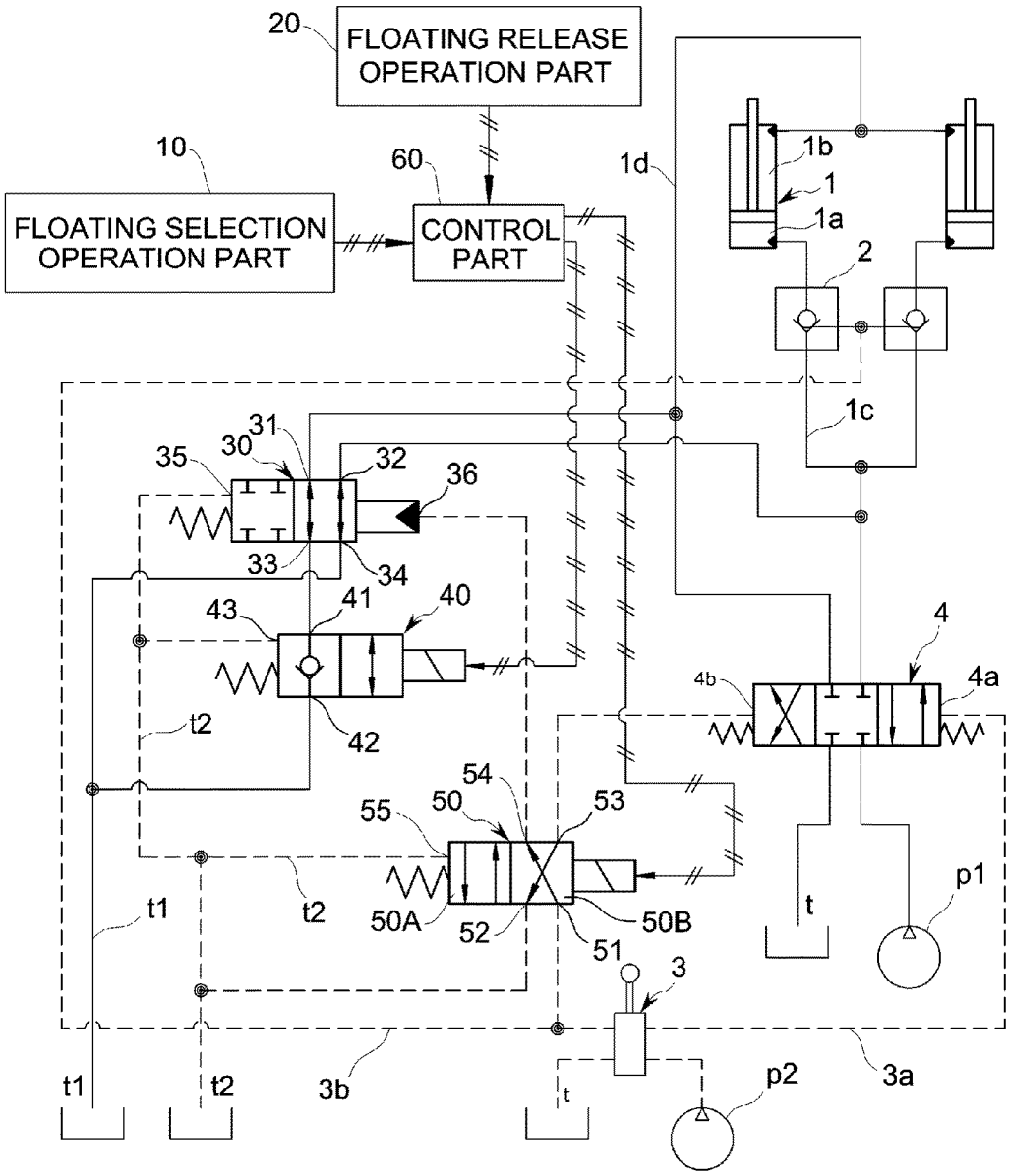
FIG. 2 is a view for explaining the boom cylinder control circuit for a construction machine according to the exemplary embodiment of the present disclosure, which schematically illustrates a state in which a bidirectional floating mode (breaker mode) is selected.
Figure 3:
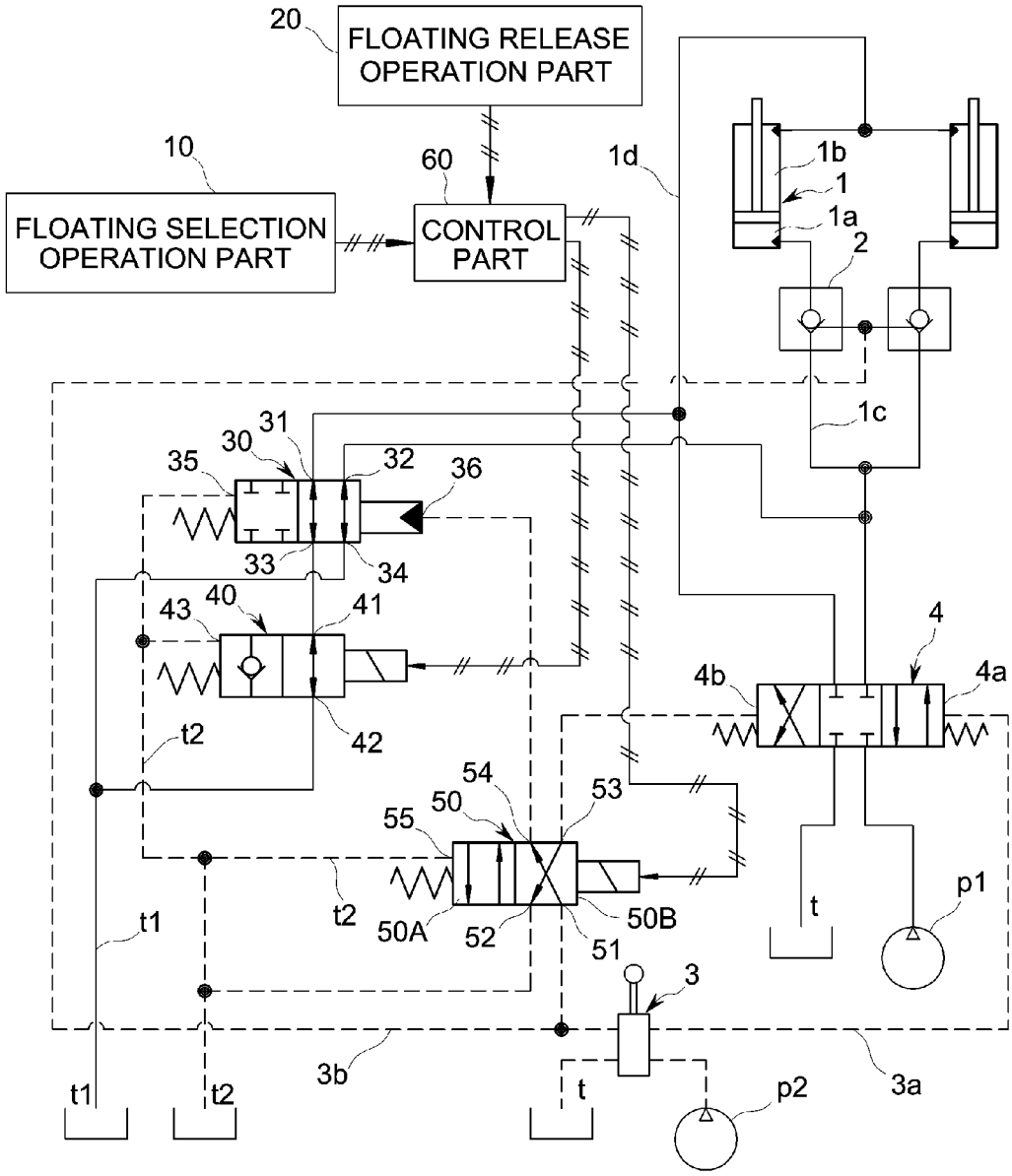
FIG. 3 is a view for explaining the boom cylinder control circuit for a construction machine according to the exemplary embodiment of the present disclosure, which schematically illustrates a state in which a unidirectional floating mode is selected.

When the signal pressure is input to a pressure receiving part 36 of the first floating valve 30, and then the first floating valve 30 is switched as illustrated in FIG. 2 or 3, the first and second input ports 31 and 32 communicate with the first and second output ports 33 and 34, respectively.

Therefore, the descending-side chamber 1*b* of the boom cylinder 1 is connected to the second floating valve 40 through the first input port 31 and the first output port 33. In this case, the descending-side chamber 1*b* of the boom cylinder 1 selectively communicates with the first drain line t1 depending on the switched state of the second floating valve 40. In addition, the ascending-side chamber 1*a* of the boom cylinder 1 communicates with the first drain line t1 through the second input port 32 and the second output port 34.

Therefore, the boom remains in a state in which the boom is moved downward by its own weight, and as a result, the bucket applies a predetermined force to the ground surface by the weight of the boom.

In the present exemplary embodiment, a configuration in which the pressure receiving part 36 is provided at the first floating valve 30 is exemplified, but the first floating valve 30 may be implemented as a solenoid type that may be provided by an electrical signal. In this case, the floating selection valve 50, which will be described below, may be omitted.

The second floating valve 40 is a floating mode selection valve for selecting any one mode of the unidirectional floating mode and the bidirectional floating mode, a first port 41 is connected to the first output port 33, and a second port 42 is connected to the first drain line t1.

In addition, the second floating valve 40 is a 2-port 2-position valve, the first port 41 communicates with the second port 42 at a first position, and the working fluid may flow from the second port 42 to the first port 41 at a second position, but the flow of the working fluid from the first port 41 to the second port 42 is restricted. The aforementioned flow of the working fluid may be implemented by a check valve.

In addition, the second spring chamber 43 of the second floating valve 40 is connected to the second drain line t2.

Therefore, the unidirectional floating mode is selected when the second floating valve 40 is switched to the second position as illustrated in FIG. 2 in a state in which the first floating valve 30 is switched to an opened state as illustrated in FIG. 2 or 3.

That is, when the first floating valve 30 is switched to the opened state, and the second floating valve 40 is switched to the first position state as illustrated in FIG. 2, the ascending-side chamber 1*a* of the boom cylinder 1 is connected to the first drain line t1, but the descending-side chamber 1*b* of the boom cylinder 1 is shut off with the first drain line t1.

Therefore, the boom cylinder 1 may be contracted, but may not be extended, and as a result, the boom may be freely moved downward, but may not be moved upward.

Therefore, the bucket may apply a predetermined load to the ground surface by the weight of the boom, but the boom is not moved upward even if impact is applied to the bucket by obstacles such as the ground surface and a rock in a direction in which the boom is moved upward.

The aforementioned state may be defined as the unidirectional floating mode, and is useful when a breaker among optional devices is used.

That is, when the breaker is used, impact may be applied to the object to be broken such as a rock while a predetermined force is applied to the object by the weight of the boom, but the boom is prevented from being moved upward by the impact, thereby efficiently performing work using the breaker.

Meanwhile, a reverse load may occur on the boom cylinder 1 when the working fluid is held at a rod side of the boom cylinder 1, and in this case, the check valve of the second floating valve 40 is opened such that the working fluid may be sucked from the first drain line t1.

That is, the working fluid is provided to the descending-side chamber 1*b* of the boom cylinder 1, such that the occurrence of cavitation may be prevented, and rattling during a boom descending motion may be prevented when the boom is moved downward due to boom floating.

Meanwhile, when both the first and second floating valves 30 and 40 are opened, both the ascending-side chamber 1*a* and the descending-side chamber 1*b* of the boom cylinder 1 are connected with the first drain line t1, such that a state of the bidirectional floating mode is formed as illustrated in FIG. 3.

The aforementioned bidirectional floating mode is a state in which the boom cylinder 1 may be freely moved upward and downward by external force, and useful to work for flattening the ground surface using the bucket or the like.

That is, in order to uniformly flatten the ground surface, a predetermined force needs to be applied to the ground surface by the weight of the bucket, and the boom needs to be freely moved upward and downward while moving the bucket in forward and rearward directions.

The second floating valve 40 is switched to a bidirectional opened state at a position or one way states at two positions based on a signal of the floating selection operation part 10.

The floating selection valve 50 serves to selectively provide the signal pressure to the pressure receiving part 36 of the first floating valve 30, and particularly, to allow the first floating valve 30 to be switched to the opened state only when a boom descending signal is generated by the boom operation part 3.

More specifically, the floating selection valve 50 is a 4-port 2-position valve, and at a first spool position 50A, a third port 51 communicates with a fifth port 53, and a fourth port 52 communicates with a sixth port 54. At a second spool position 50B, the third port 51 communicates with the sixth port 54, and the fourth port 52 communicates with the fifth port 53.

In addition, the third port 51 is connected with a descending signal line 3*b* of the boom operation part 3, the fourth port 52 is connected to the second drain line t2, the fifth port 53 is connected with the descending pressure receiving part 4*b* of the boom control unit 4, and the sixth port 54 is connected with the pressure receiving part 36 of the first floating valve 30.

In addition, a third spring chamber 55 of the floating selection valve 50 is connected to the second drain line t2.

As illustrated in FIG. 1, in a state of the first spool position 50A of the floating selection valve 50, the floating selection valve 50 connects the boom descending signal line 3*b* to the descending pressure receiving part 4*b* of the boom control unit 4, and connects the pressure receiving part 36 of the first floating valve 30 to the second drain line t2.

The aforementioned state is the general work mode in which the floating mode is not selected. Therefore, when the boom operation part 3 is operated, the signal pressure is provided to the boom control unit 4 through the boom descending signal line 3*b* or the boom ascending signal line 3*a*, and the boom cylinder 1 is extended or contracted by switching the boom control unit 4, such that the boom is moved upward or downward.

In contrast, as illustrated in FIGS. 2 and 3, in a state of the second spool position 50B of the floating selection valve 50, the floating selection valve 50 connects the boom descending signal line 3*b* to the pressure receiving part 36 of the first floating valve 30, and connects the descending pressure receiving part 4*b* of the boom control unit 4 to the second drain line t2.

Therefore, in the state as illustrated in FIG. 2, when high pressure is formed in the boom descending signal line 3*b* by operating the boom operation part 3, high-pressure signal pressure is provided to the pressure receiving part 36 of the first floating valve 30, and as a result, the first floating valve 30 is switched to the opened state as illustrated in FIG. 2 or 3.

The floating selection valve 50 is switched by a signal generated from the floating selection operation part 10.

The control part 60 serves to provide an electrical signal to the second floating valve 40 and the floating selection valve 50 based on a signal generated by the floating selection operation part 10.

More specifically, when the general work mode is selected by the floating selection operation part 10, the control part 60 does not supply an electric current to the second floating valve 40 and the floating selection valve 50.

Therefore, the second floating valve 40 and the floating selection valve 50 are present in the initial state as illustrated in FIG. 1. In this case, since the floating selection valve 50 is present in the initial state, the first floating valve 30 is present in the initial state as the pressure receiving part 36 of the first floating valve 30 is connected with the second drain line t2.

In contrast, when the unidirectional floating mode (also called 'breaker mode' because this mode is useful to breaker work) is selected by the floating selection operation part 10, the electric current is supplied to the floating selection valve 50, but the electric current is not supplied to the second floating valve 40.

Therefore, the floating selection valve 50 and the second floating valve 40 are switched to the state as illustrated in FIG. 2.

In this case, when the boom operation part 3 does not move the boom downward, the first floating valve 30 is in a closed state as illustrated in FIG. 1.

The purpose of this configuration is to prevent a safety accident from occurring when the boom falls suddenly by an operation of the floating selection operation part 10, and to allow of normal boom ascending motion by switching the boom control unit 4 when the boom operation part 3 is operated for the boom ascending motion.

Meanwhile, when a worker manipulates the boom descending motion while operating the boom operation part 3, pressure of the pilot working fluid discharged from a pilot pump p2 is provided to the pressure receiving part 36 of the first floating valve 30, such that the first floating valve 30 is switched as illustrated in FIG. 2 or 3.

Therefore, the ascending-side chamber 1*a* of the boom cylinder 1 is connected to the first drain line t1, such that the boom falls by its own weight.

In this case, the worker may adjust a speed of the boom falling by its own weight using the boom operation part 3.

That is, by reducing an operation amount of the boom operation part 3, an opening degree of the first floating valve 30 may be adjusted, and as a result, an amount of working fluid of the ascending-side chamber 1*a* of the boom cylinder 1, which is discharged to the first drain line t1, may be adjusted, such that a descending speed of the boom may be adjusted.

As described above, the first floating valve 30 is switched by the signal pressure of the boom descending signal line 3*b*, thereby preventing a safety accident due to the sudden fall of the boom.

Meanwhile, when high pressure is formed in the boom descending signal line 3*b* by the operation of the boom operation part 3, a boom holding valve 2, which is installed in a hydraulic line 1*c* of the ascending-side chamber 1*a* of the boom cylinder 1, is opened. By the aforementioned operation, the working fluid of the ascending-side chamber 1*a* of the boom cylinder 1 may be discharged.

The floating release operation part 20 serves to temporally release the floating mode, and when a floating release signal is generated by the floating release operation part 20, the control part 60 allows the floating selection valve 50 to return to the initial state as illustrated in FIG. 1.

Of course, the aforementioned function may be implemented by the operation of the floating selection operation part 10. However, in a case in which the floating mode is released through the floating selection operation part 10, it is difficult for the floating mode to return back to the current floating mode.

That is, when the floating selection operation part 10 is operated in order to release the floating function in a state in which work is currently performed in the unidirectional floating mode, the floating mode may be released.

In order to perform work in the unidirectional floating mode again, the unidirectional floating mode needs to be selected again through the floating selection operation part 10.

The worker may select the bidirectional floating mode through the floating selection operation part 10 carelessly or because the worker cannot remember the previous floating mode.

However, in a case in which the floating mode is released through the floating release operation part 20, the floating mode returns back to the original floating mode.

The reason is that the signal generated by the floating release operation part 20 switches only the floating selection valve 50.

The floating release signal generated by the floating release operation part 20 is provided to the floating selection valve 50 prior to the signal of the floating selection operation part 10. The floating release operation part 20 may be installed on the boom operation part 3 in the form of a push button in order to facilitate the aforementioned temporary operation.

Hereinafter, an operational process of the boom cylinder control circuit for a construction machine, which has the aforementioned configuration, will be described in detail.

<Explanation of Operation in General Work Mode>

First, FIG. 1 illustrates a state of the general work mode. Referring to FIG. 1, the first and second floating valves 30 and 40, and the floating selection valve 50 are switched to the initial state.

Therefore, when the boom operation part 3 is operated, the signal pressure is provided to the pressure receiving parts 4*a* and 4*b* of the boom control unit 4 through the boom descending signal line 3*b* and the boom ascending signal line 3*a*, and when the boom control unit 4 is switched in a left or right direction of FIG. 1 while corresponding to the signal of the boom operation part 3, the working fluid is supplied to the ascending-side chamber 1*a* or the descending-side chamber 1*b* of the boom cylinder 1, such that the boom is moved upward or downward.

<Explanation of Operation in Unidirectional Floating Mode>

When the unidirectional floating mode is selected through the floating selection operation part 10, the control part 60 provides a signal to the floating selection valve 50 so as to switch the first floating valve 30 and the floating selection valve 50 as illustrated in FIG. 2.

Then, the boom descending signal line 3*b* is connected with the pressure receiving part 36 of the first floating valve 30. In this case, when the boom descending signal is generated through the boom operation part 3, the working fluid of the pilot pump p2 is supplied to the pressure receiving part 36 and the boom holding valve 2 of the first floating valve 30 through the boom descending signal line 3*b*.

Accordingly, the boom holding valve 2 is opened, and the ascending-side chamber 1*a* of the boom cylinder 1 is connected to the first drain line t1.

Meanwhile, the descending-side chamber 1*b* of the boom cylinder 1 is in a state in which the discharge of the working fluid is shut off. The aforementioned state is a mode that is useful to the breaker work, such that the breaker may prevent the boom from being moved upward due to rebound while applying a predetermined force to an object such as a rock, thereby efficiently performing the breaker work.

<Explanation of Operation in Bidirectional Floating Mode>

When the bidirectional floating mode is selected through the floating selection operation part 10, the control part 60 provides an electrical signal to the second floating valve 40 and the floating selection valve 50. Then, the second floating valve 40 and the floating selection valve 50 are switched as illustrated in FIG. 3.

Accordingly, the boom descending signal line 3*b* is connected to the pressure receiving part 36 of the first floating valve 30, and the first output port 33 of the first floating valve 30 is connected to the first drain line t1.

When the boom descending signal is generated by operating the boom operation part 3 in the aforementioned state, the working fluid of the pilot pump p2 is provided to the pressure receiving part 36 of the first floating valve 30, such that the first floating valve 30 is switched to the opened state as illustrated in FIG. 3, and the boom holding valve 2 is switched to the opened state.

Accordingly, both the ascending-side chamber 1*a* and the descending-side chamber 1*b* of the boom cylinder 1 are connected with the first drain line t1. The aforementioned state is a mode that is useful to work for flattening the ground surface, a predetermined force may be applied to the ground surface by the weight of the boom when the ground surface is flattened while the bucket is moved forward and rearward, and the upward and downward movement of the boom is freely performed in accordance with the forward and rearward movement of the bucket, such that operational convenience for the worker is greatly improved.

Meanwhile, it is necessary for the worker to apply a load, which is equal to or greater than the weight of the boom, to the ground surface when work for hardening the ground surface is performed during the work for flattening the ground surface. In this case, the worker may temporarily release the floating mode through the floating release operation part 20.

When the worker generates the floating release signal through the floating release operation part 20, the control part 60 returns the floating selection valve 50 to the initial state. Then, the boom descending signal line 3*b* and the boom ascending signal line 3*a* are connected to the pressure receiving parts 4*a* and 4*b* of the boom control unit 4 again, respectively, thereby normally moving the boom upward.

When work such as the work for hardening the ground surface is completed, the worker generates the floating signal again through the floating release operation part 20. Then, the control part 60 switches the floating selection valve 50 to the state as illustrated in FIG. 3 again, thereby performing the bidirectional floating function.

As described above, the floating function may be temporarily released by the floating release operation part 20, and the floating function, which performs the previous work, may be performed when the floating function is restored again, thereby further improving operational convenience for the worker and work efficiency.

In addition, in the boom cylinder control circuit for a construction machine according to the present disclosure, a large amount of working fluid, which is discharged from the boom cylinder 1, is discharged through the first drain line t1, and a small amount of pilot working fluid, which is discharged when spools of the first and second floating valves 30 and 40, and the floating selection valve 50 are controlled, is discharged through the second drain line t2.

Accordingly, interference due to a pressure difference between a side at which the large amount of working fluid is discharged, and a side at which the small amount of working fluid is discharged does not occur, thereby more stably controlling the boom cylinder.

In addition, in the boom cylinder control circuit for a construction machine according to the present disclosure, the second drain line t2 is provided in the first, second, third spring chambers 35, 43, and 55 of the first floating valve 30, the second floating valve 40, and the floating selection valve 50, such that it is possible to prevent valve oil leakage in the valves or erroneous operations of the valves in that the spool of each of the valves does not move due to abnormal back pressure.

In addition, in the boom cylinder control circuit for a construction machine according to the present disclosure, a make-up function using the second floating valve 40 is added when unidirectional floating is performed, such that the working fluid is additionally provided to the descending-side chamber (boom cylinder rod part) 1*b* when a reverse load is applied to the boom cylinder 10, thereby resolving the problem with rattling that occurs during the operation due to cavitation.

The exemplary embodiment of the present disclosure has been described with reference to the accompanying drawings, but those skilled in the art will understand that the present disclosure may be implemented in any other specific form without changing the technical spirit or an essential feature thereof.

Accordingly, it should be understood that the aforementioned exemplary embodiment is described for illustration in all aspects and are not limited, and the scope of the present disclosure shall be represented by the claims to be described below, and it should be construed that all of the changes or modified forms induced from the meaning and the scope of the claims, and an equivalent concept thereto are included in the scope of the present disclosure.

The boom cylinder control circuit for a construction machine according to the present disclosure may be used to implement boom floating when performing flattening work, hardening work, breaking work, and the like.

The invention claimed is:

1. A boom cylinder control circuit for use with a construction machine, comprising:

a boom cylinder which has an ascending-side chamber and a descending-side chamber;

a boom control unit which is configured to provide a working fluid to the boom cylinder;

a boom operation part which is operable to drive the boom cylinder by providing a pilot working fluid to the boom control unit;

a first floating valve which is configured to allow the descending-side chamber and the ascending-side chamber to selectively communicate with or be shut off from a first drain line;

a second floating valve which is in a flow path between the descending-side chamber, which is connected with the first drain line via the first floating valve, and the first drain line, and is configured to:

allow the descending-side chamber to communicate with the first drain line, or shut off discharge of the working fluid from the descending-side chamber to the first drain line, and allow a reverse flow;

a floating selection operation part which is configured to provide an operation signal so that the second floating valve is switched in a direction in which the first floating valve and the second floating valve are communicated or shut off;

first and second input ports, which are connected to the descending-side chamber and the ascending-side chamber, respectively, and are at one side of the first floating valve;

a first output port, which is connected with the second floating valve; and a second output port, which is connected with the first drain line, wherein the first output port and the second output port are at the other side of the first floating valve.

2. The boom cylinder control circuit of claim 1, further comprising:

a floating selection valve which is connected to a boom descending signal line of the boom operation part, wherein the floating selection valve connects the boom descending signal line to a descending pressure receiving part of the boom control unit, and connects a pressure receiving part of the first floating valve to a second drain line at a first spool position, wherein the floating selection valve connects the boom descending signal line to the pressure receiving part of the first floating valve, and connects the descending pressure receiving part of the boom control unit to the second drain line at a second spool position, and wherein the floating selection valve is selectively switched to the first and second spool positions based on the operation signal of the floating selection operation part.

3. The boom cylinder control circuit of claim 2, further comprising: a floating release operation part which provides a signal prior to the signal of the floating selection operation part so as to selectively switch the floating selection valve to the first spool position or the second spool position.

4. The boom cylinder control circuit of claim 3, wherein any one spring chamber of a first spring chamber of the first floating valve, a second spring chamber of the second floating valve, and a third spring chamber of the floating selection valve is connected to the second drain line.

5. The boom cylinder control circuit of claim 2, wherein any one spring chamber of a first spring chamber of the first floating valve, a second spring chamber of the second floating valve, and a third spring chamber of the floating selection valve is connected to the second drain line.

6. The boom cylinder control circuit of claim 1, wherein any one spring chamber of a first spring chamber of the first floating valve and a second spring chamber of the second floating valve is connected to a second drain line.

* * * * *